US011486373B2

(12) United States Patent
Houguchi et al.

(10) Patent No.: US 11,486,373 B2
(45) Date of Patent: Nov. 1, 2022

(54) PUMP

(71) Applicant: NITTO KOHKI CO., LTD., Tokyo (JP)

(72) Inventors: Kousei Houguchi, Tokyo (JP); Hiroshi Nishitsuji, Tokyo (JP)

(73) Assignee: NITTO KOHKI CO., LTD., Tokyo (JP)

( * ) Notice: Subject to any disclaimer, the term of this patent is extended or adjusted under 35 U.S.C. 154(b) by 29 days.

(21) Appl. No.: 16/904,044

(22) Filed: Jun. 17, 2020

(65) Prior Publication Data

US 2020/0318627 A1 Oct. 8, 2020

Related U.S. Application Data

(63) Continuation of application No. PCT/JP2018/045244, filed on Dec. 10, 2018.

(30) Foreign Application Priority Data

Dec. 18, 2017 (JP) ..... JP2017-241709
Sep. 21, 2018 (JP) ..... JP2018-177553

(51) Int. Cl.
*F16L 55/05* (2006.01)
*F04B 39/12* (2006.01)
(Continued)

(52) U.S. Cl.
CPC ..... *F04B 11/0008* (2013.01); *F04B 39/0044* (2013.01); *F04B 39/0061* (2013.01);
(Continued)

(58) Field of Classification Search
CPC ..... F16L 55/05; F04B 39/0061; F04B 39/121; F04B 39/123; F04B 11/0008;
(Continued)

(56) References Cited

U.S. PATENT DOCUMENTS 4,988,268 A * 1/1991 Kurihara ..... F04B 39/0061 417/312
2005/0002800 A1* 1/2005 Kimura ..... F04B 39/0055 417/321
2009/0025564 A1 1/2009 Kuwabara
2009/0081058 A1* 3/2009 Ishibashi ..... H01F 7/1646 417/417

FOREIGN PATENT DOCUMENTS

EP 1903215 3/2008
EP 1903215 A1 * 3/2008 ..... F04B 35/045
(Continued)

OTHER PUBLICATIONS

JP2000045943 translation (Year: 2022).*
(Continued)

*Primary Examiner* — Kenneth J Hansen
*Assistant Examiner* — David N Brandt
(74) *Attorney, Agent, or Firm* — Burris Law, PLLC

(57) ABSTRACT

The pump has a casing accommodating a piston and a driving part. The casing has a first casing member having a driving part retaining portion retaining the driving part, a second casing member fixedly stacked on the first casing member in the reciprocating direction of the piston, and a cylindrical pump chamber peripheral wall member disposed around a head of the piston. The second casing member has an end wall portion extending in a transverse direction substantially perpendicular to the reciprocating direction. A pump chamber, a delivery chamber, and a buffer chamber are defined between the first casing member and the end wall portion of the second casing member. The pump chamber, the delivery chamber, and the buffer chamber are disposed side-by-side in the transverse direction.

5 Claims, 8 Drawing Sheets

(51) Int. Cl.

| | |
|---|---|
| ***F04B 39/00*** | (2006.01) |
| ***F04B 11/00*** | (2006.01) |
| ***F04B 19/22*** | (2006.01) |
| ***F04B 53/00*** | (2006.01) |
| ***F04B 17/04*** | (2006.01) |
| ***F04B 35/04*** | (2006.01) |
| ***F01N 1/02*** | (2006.01) |

(52) U.S. Cl.
CPC ..... *F04B 39/0072* (2013.01); *F04B 39/121* (2013.01); *F04B 39/123* (2013.01); *F01N 1/023* (2013.01); *F04B 17/044* (2013.01); *F04B 19/22* (2013.01); *F04B 35/045* (2013.01); *F04B 39/0005* (2013.01); *F04B 53/004* (2013.01)

(58) Field of Classification Search
CPC ..... F04B 17/044; F04B 19/22; F04B 35/045; F04B 39/0005; F04B 53/004; F15B 1/021
See application file for complete search history.

(56) References Cited

FOREIGN PATENT DOCUMENTS

| | | | | |
|---|---|---|---|---|
| JP | H07293448 | | 11/1995 | |
| JP | 2000045943 | * | 2/2000 | ..... F04B 35/04 |
| JP | 2003328750 | | 11/2003 | |
| JP | 2004044601 | | 2/2004 | |
| JP | 2004316447 | | 11/2004 | |
| JP | 4502522 | | 7/2010 | |
| WO | 2006121139 | | 11/2006 | |

OTHER PUBLICATIONS

Sandwich Definition & Meaning—Merriam-Webster pdf from merriam-webster.com/dictionary/sandwich (Year: 2022).*
International Search Report for International Application PCT/JP2018/045244, dated Mar. 5, 2019.
Extended Search Report from counterpart EP Application No. 18892533.3, dated Apr. 26, 2021.

* cited by examiner

PUMP

CROSS-REFERENCE TO RELATED APPLICATIONS

This application is a continuation of International Application No. PCT/JP2018/045244, filed on Dec. 10, 2018, which claims priority to and the benefit of Japanese Patent Application No. 2018-177553, filed on Sep. 21, 2018, and Japanese Patent Application No. 2017-241709, filed on Dec. 18, 2017. The disclosures of the above applications are incorporated herein by reference.

FIELD

The present disclosure relates to pumps and, more particularly, to a pump including a buffer chamber.

BACKGROUND

A pump configured to convey a fluid by reciprocating a reciprocating pumping member, e.g. a piston or a diaphragm, includes a buffer chamber temporarily storing the fluid in order to reduce the pulsation of the fluid delivered from a pump chamber by the reciprocating pumping member. Such a buffer chamber is usually formed by attaching a buffer tank to a casing that accommodates a reciprocating pumping member to form a pump chamber, the buffer tank being a discrete member from the casing (Patent Literature 1). There has also been developed a pump having a buffer chamber integrally formed in a casing (Patent Literature 2).

CITATION LIST

Patent Literature

Patent Literature 1: Japanese Patent Application Publication No. 2000-45943

Patent Literature 2: Japanese Patent Application Publication No. 2004-316447

SUMMARY

Technical Problem

In a case where a buffer chamber is formed by a buffer tank discrete from the casing, however, the number of parts increases, and the assembly becomes complicated. In addition, it is necessary to seal between a discharge port of the casing and an inlet of the buffer tank, and there is likelihood of leakage of fluid due to possible degradation of the seal performance of the sealing part. Regarding the above-described pump having the buffer chamber integrally formed in the casing, the buffer chamber is located at a position adjacent to the pump chamber in the reciprocating direction of the piston; therefore, the casing increases in size in the reciprocating direction. When the pump is in the installed position, the piston is usually disposed so as to reciprocate in the horizontal direction. Therefore, as the casing increases in size in the reciprocating direction, the installation area of the pump increases, making it difficult to place the pump in a narrow space.

Accordingly, an object of the present invention is to provide a pump configured to be capable of suppressing the increase in size in the reciprocating direction of a reciprocating pumping member while allowing a buffer chamber to be integrally formed in a casing.

Solution to Problem

The present invention provides a pump including a reciprocating pumping member, a driving part configured to reciprocate the reciprocating pumping member, and a casing accommodating the reciprocating pumping member and the driving part. The pump is configured to convey a fluid by the reciprocating motion of the reciprocating pumping member. The casing has the following: a first casing member having a driving part retaining portion retaining the driving part; a second casing member fixedly stacked on the first casing member in the reciprocating direction of the reciprocating pumping member, the second casing member having an end wall portion facing the reciprocating pumping member in the reciprocating direction and extending in a transverse direction crossing the reciprocating direction; and a cylindrical pump chamber peripheral wall portion extending in the reciprocating direction between the driving part retaining portion and the end wall portion around the reciprocating pumping member. Between the first casing member and the end wall portion of the second casing member are defined a pump chamber, a delivery chamber, and a buffer chamber. The pump chamber is located inside the pump chamber peripheral wall portion and has a volumetric capacity varied by the reciprocating motion of the reciprocating pumping member. The delivery chamber is located around the pump chamber peripheral wall portion and communicates with the pump chamber through a first communication passage extending through the pump chamber peripheral wall portion in the transverse direction. The buffer chamber is adjacent to the delivery chamber in the transverse direction and communicates with the delivery chamber through a second communication passage extending in the transverse direction.

In the pump, the buffer chamber is integrally formed with the casing; therefore, it is unnecessary to use a buffer tank prepared as a discrete member. In addition, the delivery chamber and the buffer chamber are disposed side-by-side relative to the pump chamber in a transverse direction crossing the reciprocating direction of the reciprocating pumping member. Therefore, the size of the casing in the reciprocating direction of the reciprocating pumping member can be prevented from increasing due to the buffer chamber.

The pump may further include a passage member defining the second communication passage, the passage member being sandwiched between the first casing member and the second casing member.

The second communication passage may be configured to have a cross-sectional area decreasing as the distance increases toward the buffer chamber.

The pump may further include an external communication passage extending from an inlet opening located inside the buffer chamber to an outlet opening located outside the buffer chamber, the external communication passage having a tapering flow path portion with a cross-sectional area decreasing as the distance from the inlet opening increases toward the outlet opening.

The provision of such a tapering flow path portion makes it possible to reduce the fluid resistance when the fluid is discharged from the buffer chamber to the outside of the pump.

Embodiments of a pump according to the present invention will be explained below on the basis of the accompanying drawings.

DRAWINGS

DETAILED DESCRIPTION

Figure 1:
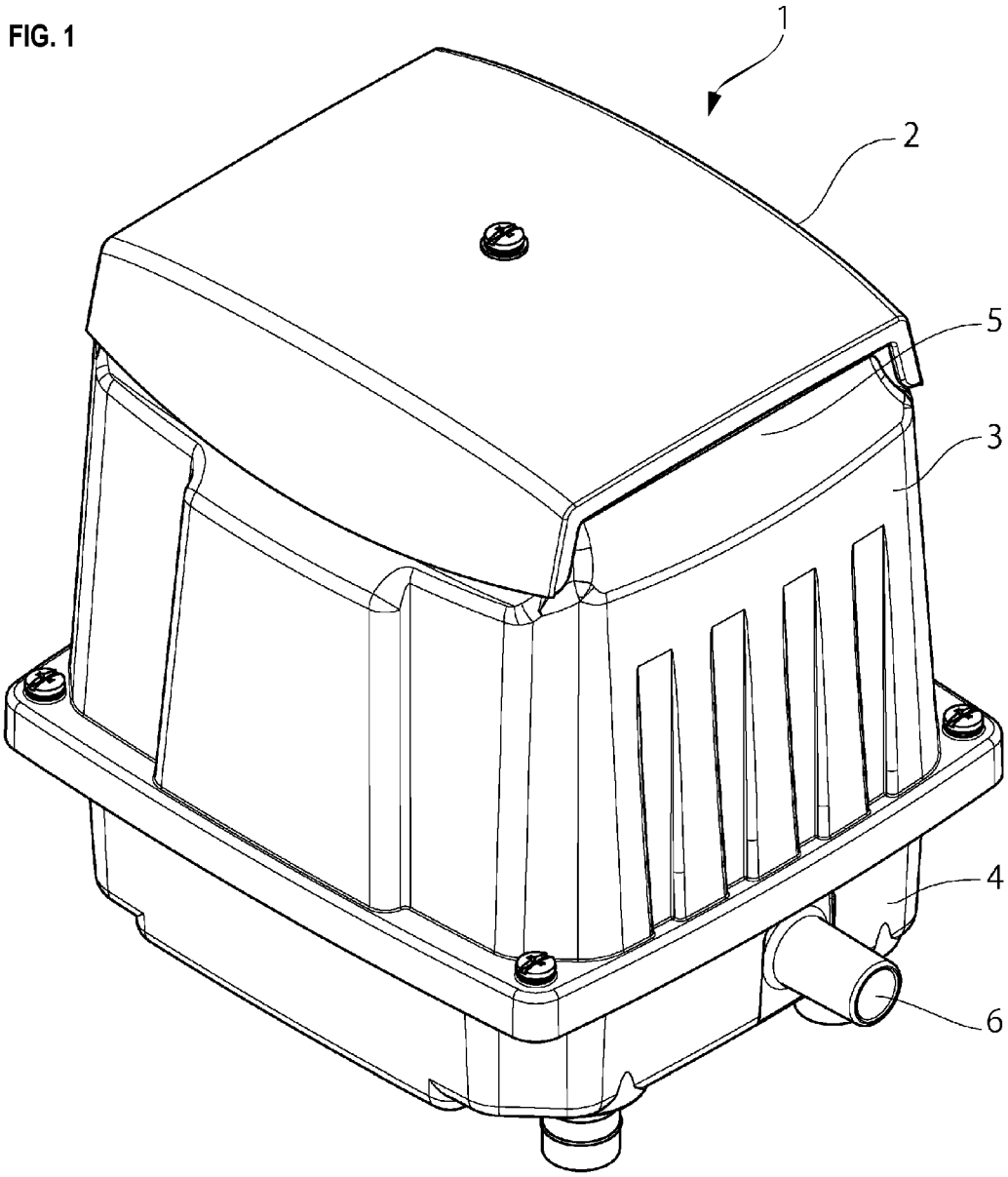
FIG. 1 is an external view of a pump according to a first embodiment of the present invention.

As shown in FIG. 1, a pump 1 according to a first embodiment of the present invention has a cover 2 comprising an upper cover 3 and a lower cover 4. The pump 1 is configured to suck the ambient air into the cover 2 from an external suction port 5 provided in the upper cover 3 and to discharge compressed air from an external discharge port 6 projecting to the outside from the lower cover 4. The air sucked into the cover 2 from the external suction port 5 is sucked into a casing 10, shown in FIG. 2, from two suction ports 12 formed in a rear end face 10*a* of the casing 10. The sucked air is compressed in the casing 10 and discharged from the external discharge port 6.

Figure 3:
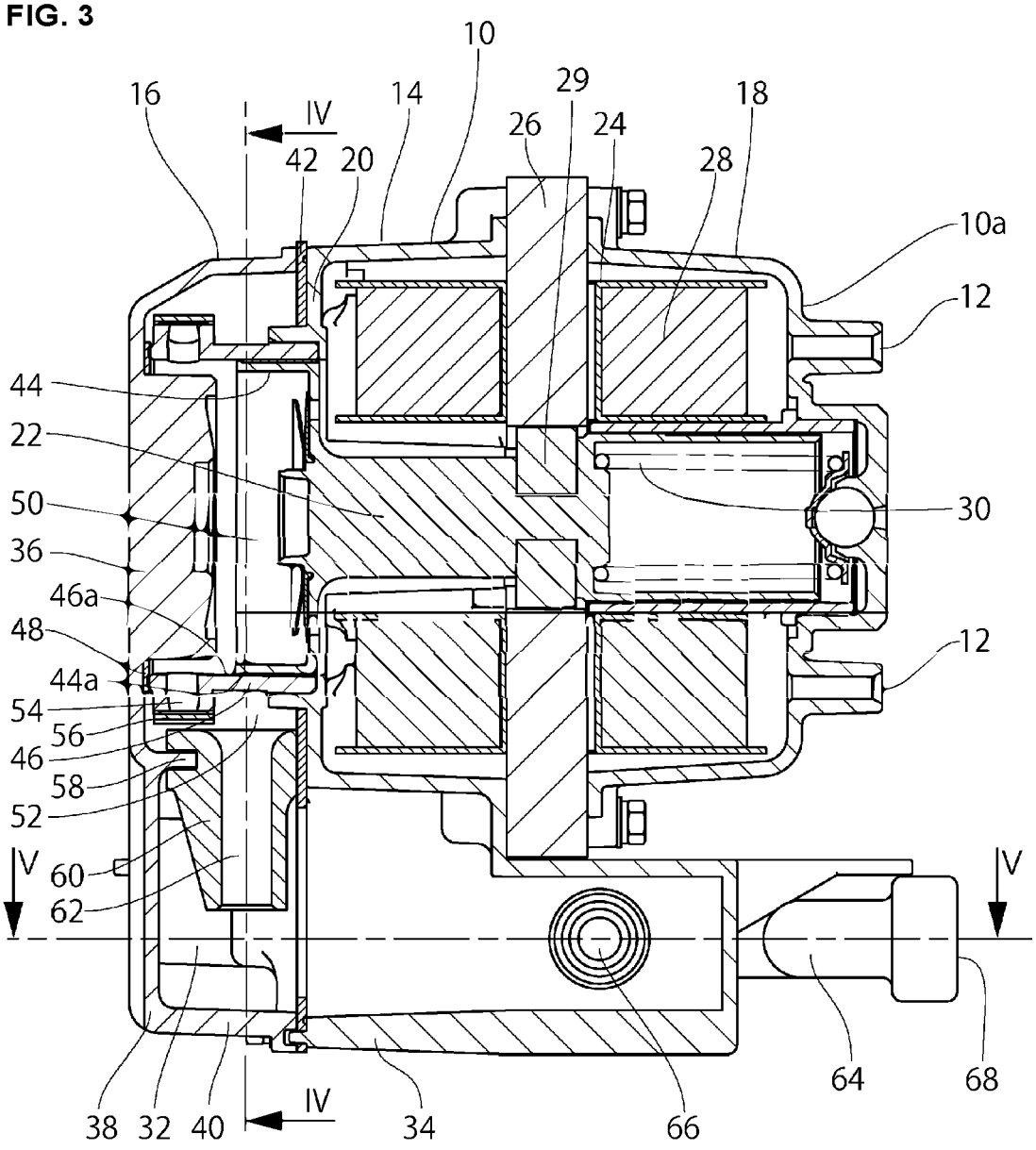
FIG. 3 is a side sectional view of the pump with a cover removed therefrom.

As shown in FIG. 3, the casing 10 has a central, first casing member 14, a forward, second casing member 16, and a rearward, third casing member 18. The first casing member 14 has a driving part retaining portion 20. Between the driving part retaining portion 20 and the third casing member 18 is accommodated and retained a driving part 24 for reciprocating a piston (reciprocating pumping member) 22. The driving part 24 mainly comprises a field core 26 and two coils 28 wound around the field core 26. When an alternating current voltage is applied to the coils 28, a periodic magnetic field is produced by the field core 26. The produced magnetic field draws an armature 29 of the piston 22 into the field core 26, thereby displacing the piston 22 rightward as seen in the figure. When the attraction force of the magnetic field decreases, the piston 22 is displaced leftward as seen in the figure by the urging force of a spring 30 disposed between the piston 22 and the third casing member 18. When the attraction force of the magnetic field increases again, the piston 22 is displaced rightward against the urging force of the spring 30. In this way, the piston 22 reciprocates horizontally as seen in the figure in response to the periodic change of the magnetic field.

The first casing member 14 has the above-described driving part retaining portion 20 and a buffer chamber forming portion 34 for forming a buffer chamber 32 (described later). The second casing member 16 has an end wall portion 36 facing the piston 22 in the reciprocating direction (horizontal direction as seen in FIG. 3) of the piston 22 and extending in the transverse direction (vertical direction as seen in FIG. 3) crossing the reciprocating direction at substantially right angles, and a peripheral wall portion 40 extending from a peripheral edge 38 of the end wall portion 36 toward the first casing member 14. The second casing member 16 is fixedly stacked on the first casing member 14 in the reciprocating direction of the piston 22. A sheet-shaped seal member 42 is sandwiched between the first casing member 14 and the second casing member 16. Through the seal member 42, the first casing member 14 and the second casing member 16 are sealingly engaged with each other. The casing 10 further has a cylindrical pump chamber peripheral wall member (pump chamber peripheral wall portion) 46 extending in the reciprocating direction between the driving part retaining portion 20 of the first casing member 14 and the end wall portion 36 of the second casing member 16 around a head 44 of the piston 22. An inner peripheral surface 46*a* of the pump chamber peripheral wall member 46 and an outer peripheral surface 44*a* of the head 44 of the piston 22 are sliding surfaces, respectively, which are machined with high precision so that there is no gap therebetween. Practically, the inner peripheral surface 46*a* and the outer peripheral surface 44*a* are sealed to each other. In addition, the area between the pump chamber peripheral wall member 46 and the end wall portion 36 of the second casing member 16 is sealed by an annular seal member 48. Thus, a pump chamber 50 is defined inside the pump chamber peripheral wall member 46 between the driving part retaining portion 20 of the first casing member 14 and the end wall portion 36 of the second casing member 16. The pump chamber 50 is varied in volumetric capacity by the reciprocating motion of the piston 22.

In addition, between the driving part retaining portion 20 of the first casing member 14 and the end wall portion 36 of the second casing member 16 is formed a delivery chamber 52 located around the pump chamber peripheral wall member 46. The pump chamber peripheral wall member 46 is formed with a first communication passage 54 extending therethrough in a transverse direction crossing the reciprocating direction. The delivery chamber 52 communicates with the pump chamber 50 through the first communication passage 54. The first communication passage 54 has a check valve 56 attached at a side thereof opening into the delivery chamber 52. The check valve 56 is configured to pass only a fluid flowing from the pump chamber 50 toward the delivery chamber 52. It should be noted that there are formed eight first communication passages 54, and that four check valves 56 (FIG. 4) are disposed so that each check valve 56 closes two first communication passages 54.

Figure 4:
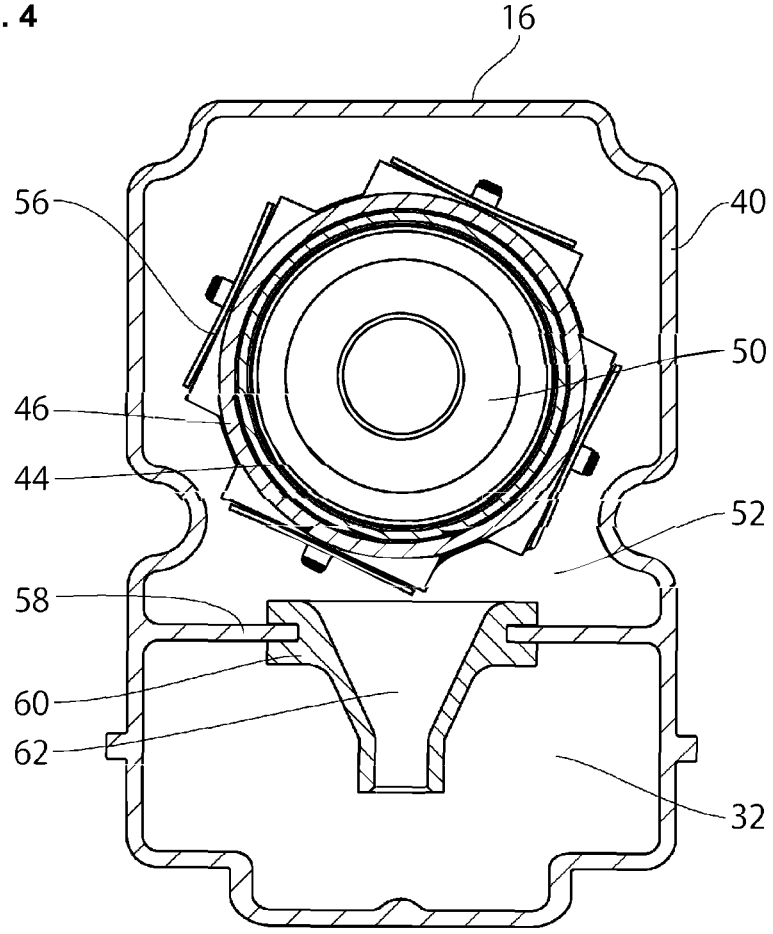
FIG. 4 is a sectional view taken along the line IV-IV in FIG. 3.

Between the buffer chamber forming portion 34 of the first casing member 14 and the end wall portion 36 of the second casing member 16 is defined a buffer chamber 32 partitioned off from the delivery chamber 52 by a partition 58 of the second casing member 16, the buffer chamber 32 being adjacent to the delivery chamber 52 in the transverse direction. The buffer chamber 32 extends in the reciprocating direction from the end wall portion 36 of the second casing member 16 to the lower side of the driving part 24. A passage member 60 is sandwiched and secured between the first casing member 14 and the partition 58 of the second casing member 16. The passage member 60 is formed with a second communication passage 62 extending in the transverse direction so as to provide communication between the delivery chamber 52 and the buffer chamber 32. The second communication passage 62 is, as shown in FIG. 4, tapered so as to have a cross-sectional area decreasing as the distance increases toward the buffer chamber 32.

Figure 2:
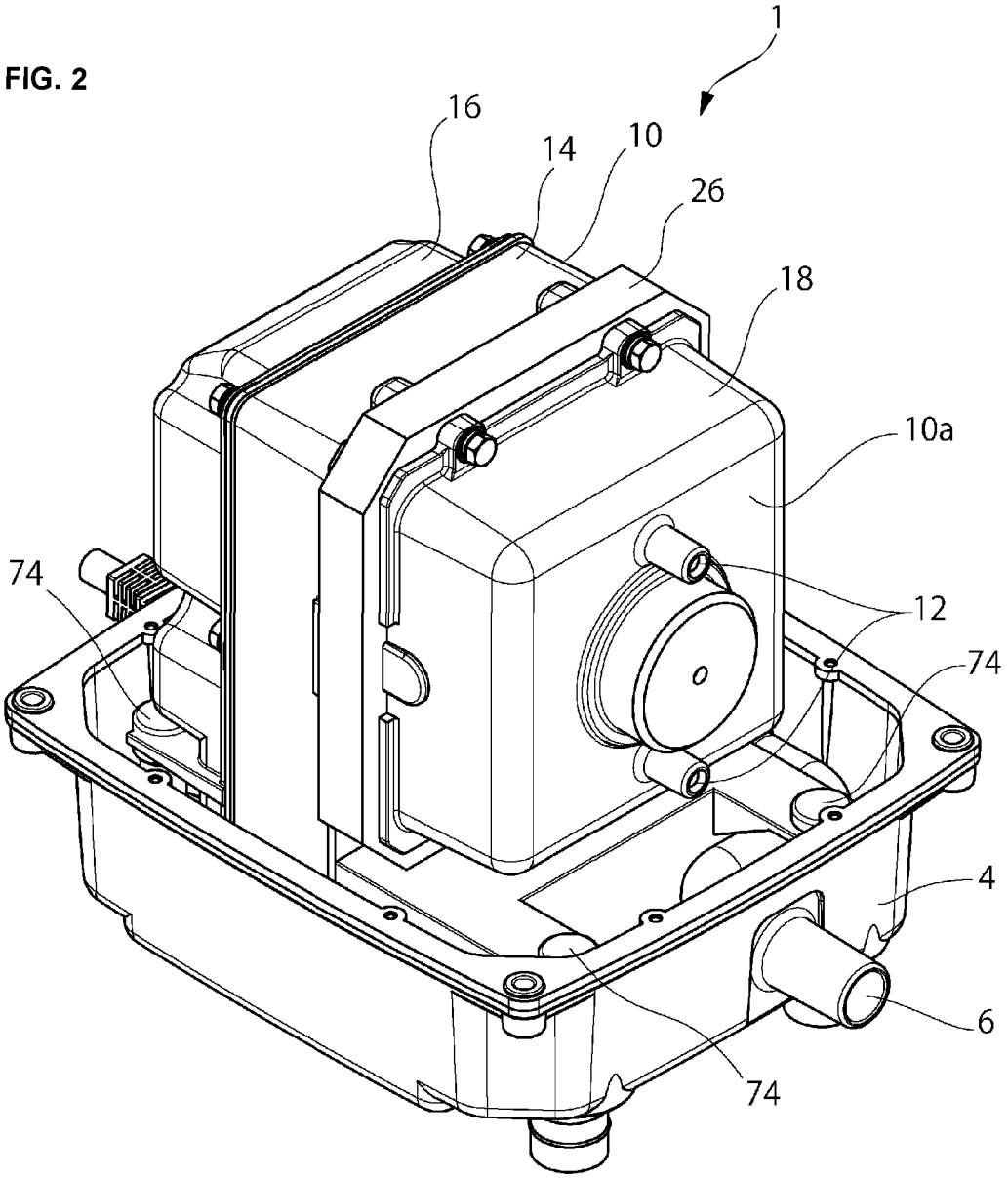
FIG. 2 is a perspective view of the pump in FIG. 1, with an upper cover removed therefrom.
Figure 5:
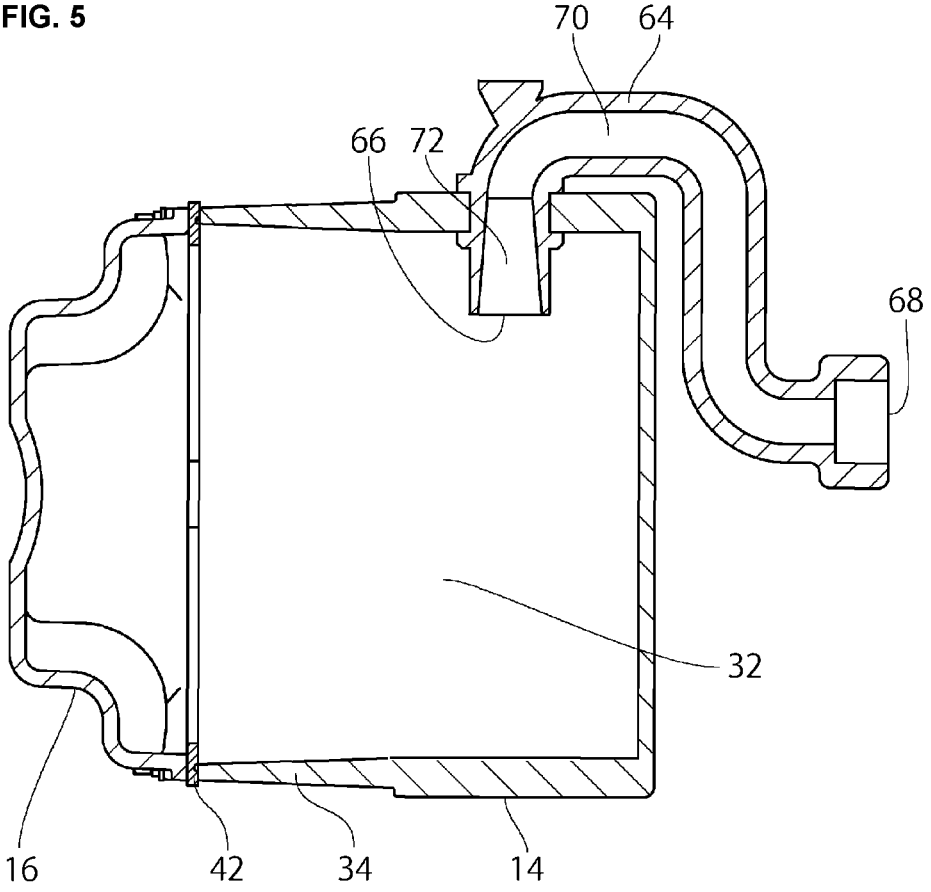
FIG. 5 is a sectional view taken along the line V-V in FIG. 3.

As shown in FIG. 5, a discharge pipe 64 is attached to the buffer chamber forming portion 34 of the first casing member 14. The discharge pipe 64 has an external communication passage 70 extending while bending from an inlet opening 66 located inside the buffer chamber 32 to an outlet opening 68 located outside the buffer chamber 32. The external communication passage 70 has a tapering flow path portion 72 formed near the inlet opening 66. The tapering flow path portion 72 has a cross-sectional area decreasing as the distance from the inlet opening 66 increases toward the outlet opening 68. The outlet opening 68 is secured to the cover 2 so as to communicate with the external discharge port 6 of the cover 2. As the piston 22 reciprocates, the first casing member 14 receives the vibration of the piston 22 and vibrates in the reciprocating direction of the piston 22. In this regard, however, the discharge pipe 64 is bent, as shown in the figure, so as to have flexibility in the reciprocating direction of the piston 22. Therefore, the vibration that the first casing member 14 receives is absorbed by the discharge pipe 64 so that the vibration cannot easily be propagated to the cover 2. It should be noted that the casing 10 is, as shown in FIG. 2, attached to the lower cover 4 through elastic support members 74 made of rubber.

When the piston 22 is reciprocated, the volumetric capacity of the pump chamber 50 is varied. More specifically, when the piston 22 is displaced leftward as seen in the figure, the volumetric capacity of the pump chamber 50 decreases, whereas, when the piston 22 is displaced rightward as seen in the figure, the volumetric capacity of the pump chamber 50 increases. When the volumetric capacity of the pump chamber 50 is decreased by the piston 22, the air in the pump chamber 50 is compressed. The pressure of the compressed air opens the check valve 56, and the air in the pump chamber 50 is delivered into the delivery chamber 52 through the first communication passage 54. At the same time, air is sucked into the casing 10 from the suction ports 12 of the third casing member 18. It should be noted that the two suction ports 12 are each disposed at the center position of the associated coil 28, so that the sucked air hits and flows around the coil 28. Thus, the coils 28 can be cooled efficiently.

The air delivered from the pump chamber 50 into the delivery chamber 52 is introduced into the buffer chamber 32 through the second communication passage 62. The buffer chamber 32 has a large volumetric capacity as compared to the pump chamber 50 and the delivery chamber 52 and thus temporarily stores the air conveyed from the pump chamber 50 through the delivery chamber 52. The air delivered from the pump chamber 50 has periodic pulsations. The pulsations of the air, however, are reduced to a considerable extent as a result of the air being temporarily stored in the buffer chamber 32 having a relatively large volumetric capacity. The air having being temporarily stored in the buffer chamber 32 is discharged to the outside from the external discharge port 6 through the external communication passage 70.

In the pump 1, the buffer chamber 32 is integrally formed in the casing 10, together with the pump chamber 50 and the delivery chamber 52. In the integrated structure, the delivery chamber 52 and the buffer chamber 32 are disposed side-by-side relative to the pump chamber 50 in a transverse direction crossing the reciprocating direction of the piston 22 at substantially right angles. Therefore, the delivery chamber 52 and the buffer chamber 32 do not cause an increase in the overall dimensions of the casing 10 and the pump 1 in the reciprocating direction. Consequently, the installation area of the pump 1 can be reduced. In addition, the second casing member 16 is fixedly stacked on the first casing member 14 in the reciprocating direction of the piston 22, thereby defining the pump chamber 50, the delivery chamber 52, and the buffer chamber 32 between the first casing member 14 and the second casing member 16. That is, the pump chamber 50, the delivery chamber 52, and the buffer chamber 32 are defined substantially by the first casing member 14 and the second casing member 16; therefore, the number of parts constituting the casing 10 reduces as compared to the conventional pump having a buffer chamber integrally formed in a casing. In addition, because the number of seal points also reduces, the sealing reliability can be increased.

Figure 6:
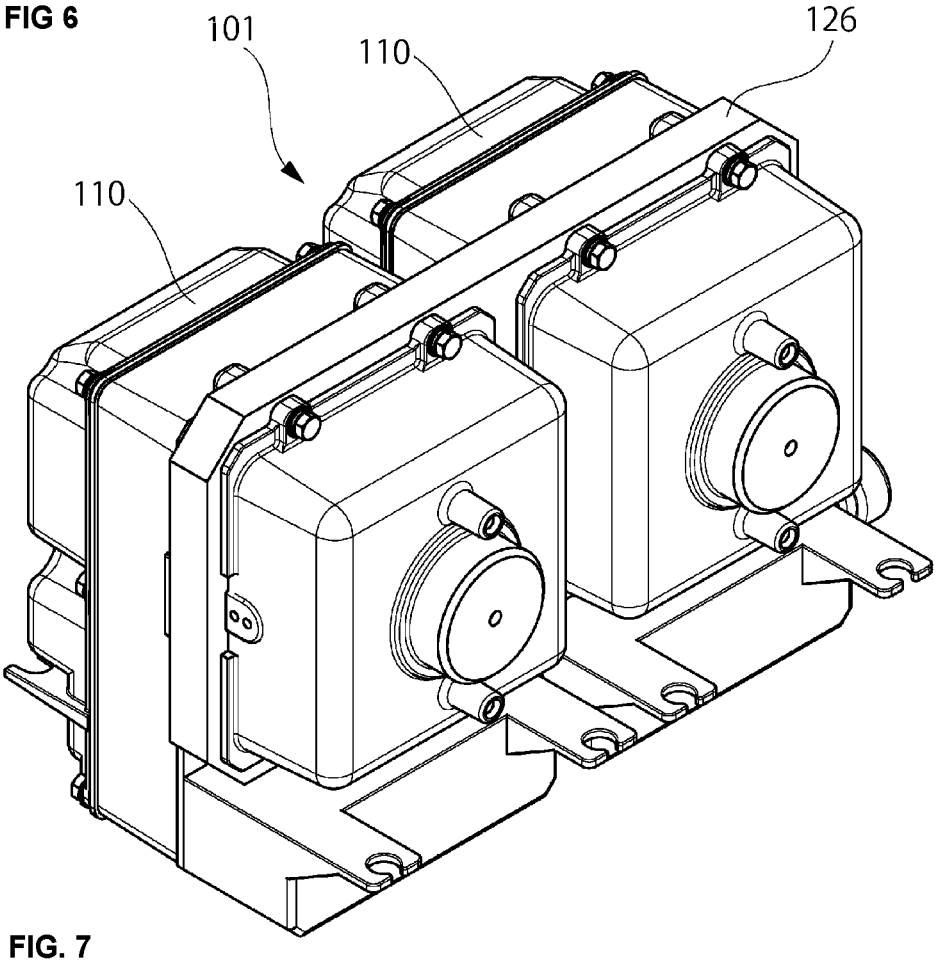
FIG. 6 is a perspective view of a pump according to a second embodiment of the present invention, with a cover removed therefrom.
Figure 7:
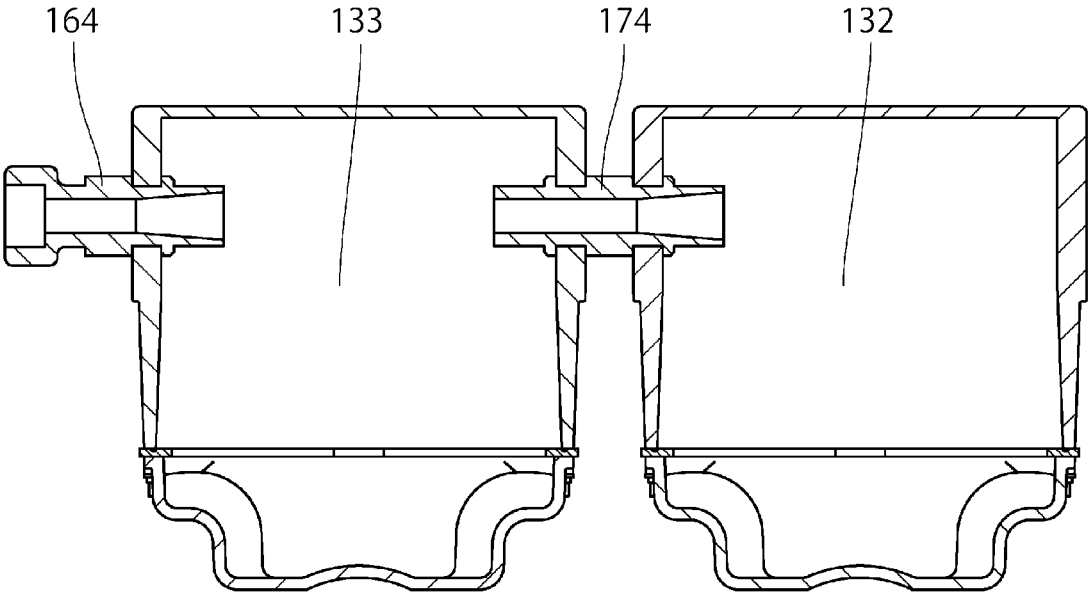
FIG. 7 is a top sectional view of the pump in FIG. 6 taken along a plane crossing buffer chambers.

As shown in FIG. 6, a pump 101 according to a second embodiment of the present invention has a pair of structures each arranged as shown in FIGS. 3 to 5 of the first embodiment. It should, however, be noted that a field core 126 is formed as a single member common to two driving parts, and that two casings 110 are connected to each other through the field core 126. In addition, as shown in FIG. 7, two buffer chambers 132 and 133 are connected to each other through a connecting pipe 174, and a discharge pipe 164 projects to the outside from only one buffer chamber 133. With the above-described structure, the pump 101 has a discharge quantity about twice as large as that of the pump 1 according to the first embodiment.

Figure 8:
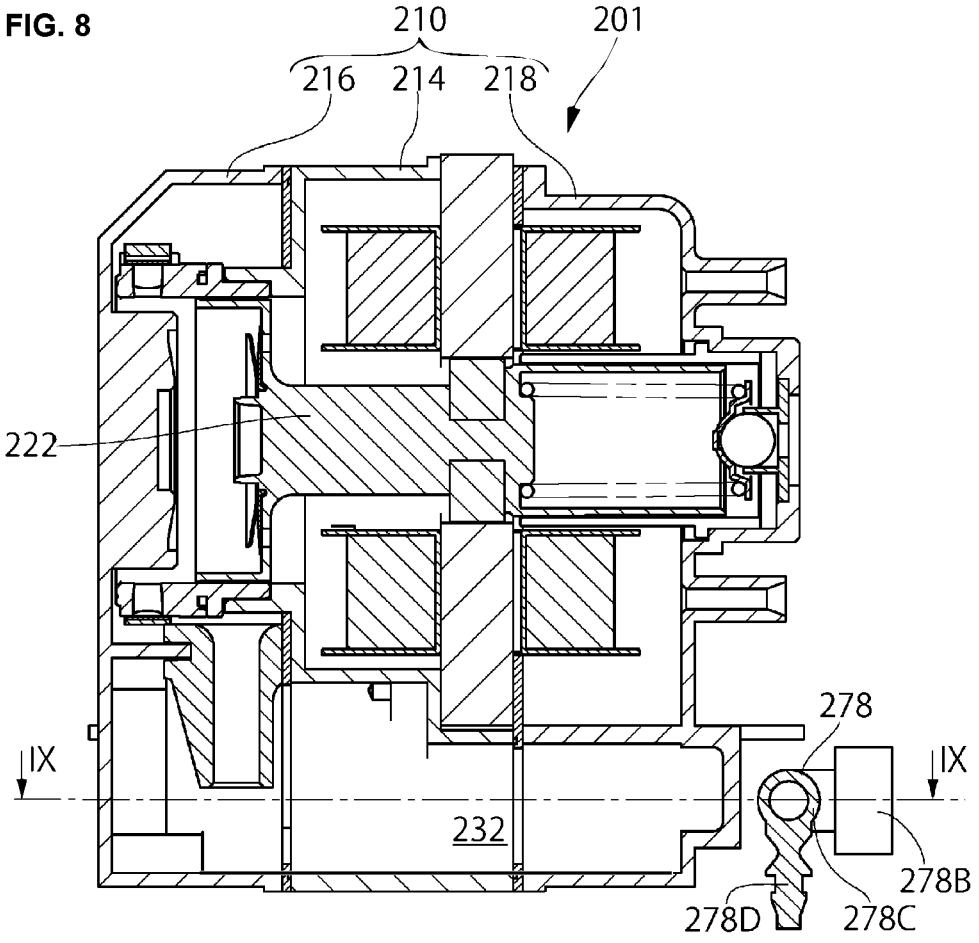
FIG. 8 is a side sectional view of a pump according to a third embodiment of the present invention, with a cover removed therefrom.
Figure 9:
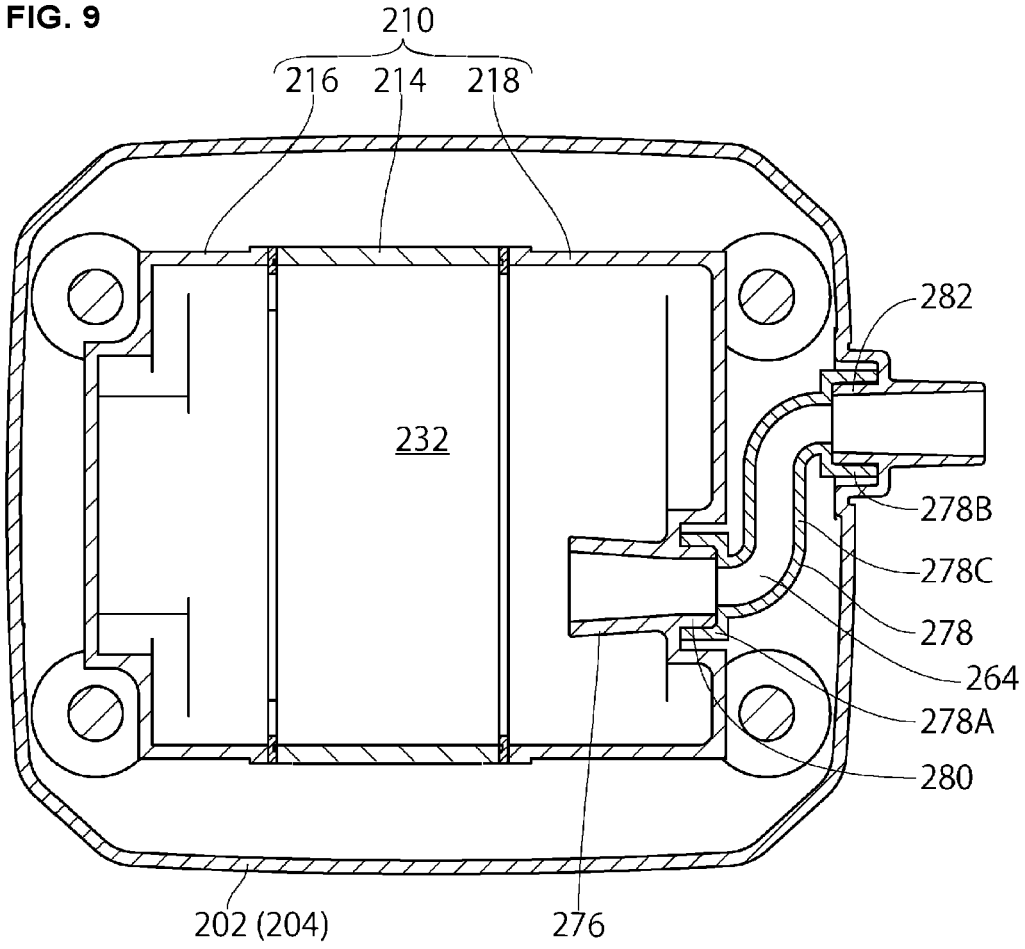
FIG. 9 is a sectional view taken along the line IX-IX in FIG. 8.

Referring to FIGS. 8 and 9, in a pump 201 according to a third embodiment of the present invention, a buffer chamber 232 is formed by a first casing member 214, a second casing member 216, and a third casing member 218. A discharge pipe 264 comprises a fixed pipe portion 276 integrally formed with the third casing member 218, and a pliable rubber tube 278 attached between the third casing member 218 and a lower cover 204. The rubber tube 278 has a first attaching portion 278A attached to a tube attaching portion 280 of the third casing member 218, a second attaching portion 278B attached to a tube attaching portion 282 of the lower cover 204, and an intermediate portion 278C extending between the first attaching portion 278A and the second attaching portion 278B. The intermediate portion 278C is disposed to extend in a direction substantially perpendicular to the reciprocating direction of a piston 222. The rubber tube 278 further has a securing portion 278D extending downward from the intermediate portion 278C. The securing portion 278D is secured to the lower cover 204 to support the rubber tube 278. Thus, a casing 210 and a cover 202 are connected to each other through the above-described rubber tube 278. Therefore, vibration caused by the reciprocating motion of the piston 222 cannot easily be propagated to the cover 202. It should be noted that it is desirable for the pump 201 to replace the piston 222 periodically. A replacing operation of the piston 222 is carried out with the casing 210 removed from the lower cover 204. In this embodiment, the first attaching portion 278A of the rubber tube 278 is attached to the tube attaching portion 280 located outside the third casing member 218. Therefore, the casing 210 can be easily removed from the lower cover 204 by detaching the first attaching portion 278A from the tube attaching portion 280.

Although some embodiments of the present invention have been described above, the present invention is not limited to the described embodiments. For example, the pumps in the foregoing embodiments are piston pumps, but a pump in accordance with this invention may be a pump of other type, e.g. a diaphragm pump in which a fluid is conveyed by reciprocating a diaphragm. Further, the fluid to be conveyed is not limited to air but may be other gas or other fluid, e.g. water. The peripheral wall portion and partition that the second casing member has may be provided on the first casing member. Further, in the foregoing embodiments, the pump chamber peripheral wall member, which is required to be machined with high precision, is formed as a single member; however, the pump chamber peripheral wall member may be integrally formed with the first casing member or the second casing member. The configuration of the pump chamber peripheral wall member is not limited to a circular cylindrical shape but may be other cylindrical shape, e.g. an elliptical or quadrangular cylindrical shape, in conformity to the shape of the head of the piston or the diaphragm. Although the foregoing second embodiment has a pair of structures each arranged as shown in FIGS. 3 to 5 of the first embodiment, three or more such structures may be connected together. The field core may be separated for each casing, instead of being an integrated member. Further, it is possible to make a design change, as appropriate, as to how a plurality of buffer chambers are connected together. For example, the arrangement may be such that the buffer chambers are not connected together but configured to each discharge a fluid individually.

REFERENCE SIGNS LIST

1: pump; 2: cover; 3: upper cover; 4: lower cover; 5: external suction port; 6: external discharge port; 10: casing; 10*a*: rear end face; 12: suction ports; 14: first casing member; 16: second casing member; 18: third casing member; 20: driving part retaining portion; 22: piston (reciprocating pumping member); 24: driving part; 26: field core; 28: coils; 29: armature; 30: spring; 32: buffer chamber; 34: buffer chamber forming portion; 36: end wall portion; 38: peripheral edge; 40: peripheral wall portion; 42: seal member; 44: head; 44*a*: outer peripheral surface; 46: pump chamber peripheral wall member (pump chamber peripheral wall portion); 46*a*: inner peripheral surface; 48: seal member; 50: pump chamber; 52: delivery chamber; 54: first communication passage; 56: check valve; 58: partition; 60: passage member; 62: second communication passage; 64: discharge pipe; 66: inlet opening; 68: outlet opening; 70: external communication passage; 72: tapering flow path portion; 74: elastic support members; 101: pump; 110: casings; 126: field core; 132: buffer chamber; 133: buffer chamber; 164: discharge pipe; 174: connecting pipe; 201: pump; 202: cover; 204: lower cover; 210: casing; 214: first casing member; 216: second casing member; 218: third casing member; 222: piston; 232: buffer chamber; 264: discharge pipe; 276: fixed pipe portion; 278: rubber tube; 278A: first attaching portion; 278B: second attaching portion; 278C: intermediate portion; 278D: securing portion; 280: tube attaching portion; 282: tube attaching portion.

What is claimed is:

1. A pump comprising: a reciprocating pumping member; a driving part configured to reciprocate the reciprocating pumping member; and a casing accommodating the reciprocating pumping member and the driving part; the pump being configured to convey a fluid by a reciprocating motion of the reciprocating pumping member; the casing having: a first casing member having a driving part retaining portion retaining the driving part; a second casing member fixedly stacked on the first casing member in a reciprocating direction of the reciprocating pumping member, the second casing member having an end wall portion facing the reciprocating pumping member in the reciprocating direction and extending in a transverse direction crossing the reciprocating direction; and a cylindrical pump chamber peripheral wall portion extending in the reciprocating direction between the driving part retaining portion and the end wall portion around the reciprocating pumping member; wherein a pump chamber, a delivery chamber, and a buffer chamber are defined between the first casing member and the end wall portion of the second casing member, the pump chamber being located inside the pump chamber peripheral wall portion and having a volumetric capacity varied by the reciprocating motion of the reciprocating pumping member, the delivery chamber being located around the pump chamber peripheral wall portion and communicating with the pump chamber through a first communication passage extending through the pump chamber peripheral wall portion in the transverse direction, and the buffer chamber being adjacent to the delivery chamber in the transverse direction and communicating with the delivery chamber through a second communication passage extending in the transverse direction, wherein the first casing member further has a buffer chamber forming portion that is adjacent to the driving part retaining portion in the transverse direction and defines at least a part of the buffer chamber.

2. The pump of claim 1, further comprising a passage member defining the second communication passage, the passage member being sandwiched between the first casing member and the second casing member.

3. The pump of claim 1, wherein the second communication passage is configured to have a cross-sectional area decreasing as a distance increases toward the buffer chamber.

4. The pump of claim 1, further comprising an external communication passage extending from an inlet opening located inside the buffer chamber to an outlet opening located outside the buffer chamber, the external communication passage having a tapering flow path portion with a cross-sectional area decreasing as a distance from the inlet opening increases toward the outlet opening.

5. The pump of claim 1, wherein:

the pump chamber, the delivery chamber, and the buffer chamber are disposed side-by-side in the transverse direction.

* * * * *